US008726819B2

(12) United States Patent
Tamura et al.

(10) Patent No.: US 8,726,819 B2
(45) Date of Patent: May 20, 2014

(54) BURNER

(75) Inventors: Masato Tamura, Tokyo (JP); Shinji Watanabe, Tokyo (JP)

(73) Assignee: IHI Corporation, Tokyo (JP)

( * ) Notice: Subject to any disclaimer, the term of this patent is extended or adjusted under 35 U.S.C. 154(b) by 149 days.

(21) Appl. No.: 13/057,762

(22) PCT Filed: Mar. 27, 2009

(86) PCT No.: PCT/JP2009/001382

§ 371 (c)(1),
(2), (4) Date: Feb. 5, 2001

(87) PCT Pub. No.: WO2010/016168

PCT Pub. Date: Feb. 11, 2010

(65) Prior Publication Data

US 2011/0139048 A1 Jun. 16, 2011

(30) Foreign Application Priority Data

Aug. 8, 2008 (JP) ..... 2008-205735

(51) Int. Cl.
*F23C 1/10* (2006.01)

(52) U.S. Cl.
USPC ..... 110/262; 110/260; 110/261; 110/263; 110/264; 110/265; 110/104 B; 110/211; 110/347

(58) Field of Classification Search
USPC ..... 110/104 B, 211, 260–265, 347; 239/400–405; 431/181–187
See application file for complete search history.

(56) References Cited

U.S. PATENT DOCUMENTS

| | | | | |
|---|---|---|---|---|
| 4,924,784 | A * | 5/1990 | Lennon et al. | 110/261 |
| 4,930,430 | A | 6/1990 | Allen et al. | |
| 5,806,443 | A * | 9/1998 | Kobayashi et al. | 110/262 |
| 5,823,764 | A | 10/1998 | Alberti et al. | |
| 6,145,450 | A * | 11/2000 | Vatsky | 110/265 |
| 7,878,130 | B2 * | 2/2011 | Yamamoto et al. | 110/214 |
| 2005/0211142 | A1 | 9/2005 | Yamamoto et al. | |

(Continued)

FOREIGN PATENT DOCUMENTS

| | | |
|---|---|---|
| JP | 58-127005 | 7/1983 |
| JP | 61 252412 | 11/1986 |

(Continued)

OTHER PUBLICATIONS

Office Action issued Apr. 18, 2012 in German Application No. 112009 001 943.9.

(Continued)

*Primary Examiner* — Kenneth Rinehart
*Assistant Examiner* — Gajanan M Prabhu
(74) *Attorney, Agent, or Firm* — Oblon, Spivak, McClelland, Maier & Neustadt, L.L.P.

(57) ABSTRACT

A burner is arranged axially of a burner throat on a furnace wall and includes a nozzle body housed in a wind box and with a secondary air adjuster on a leading end of the nozzle body. The adjuster includes an end plate for defining together with a near-furnace side surface of the wind box a cylindrical space opened in an outer circumference thereof, a slide damper axially slidable for surrounding the cylindrical space, air vanes arranged at predetermined intervals and circumferentially of the cylindrical space for swirling a secondary air and drive means and for slide movement of the slide damper.

16 Claims, 11 Drawing Sheets

(56) References Cited

U.S. PATENT DOCUMENTS

| | | | | |
|---|---|---|---|---|
| 2010/0018445 | A1* | 1/2010 | Li et al. | 110/264 |
| 2010/0058961 | A1 | 3/2010 | Fujimori et al. | |
| 2010/0307391 | A1 | 12/2010 | Tamura et al. | |

FOREIGN PATENT DOCUMENTS

| | | |
|---|---|---|
| JP | 61 272512 | 12/1986 |
| JP | 8 14510 | 1/1996 |
| JP | 8-145320 | 6/1996 |
| JP | 10-274405 | 10/1998 |
| JP | 11-44411 | 2/1999 |
| JP | 2005 273973 | 10/2005 |

OTHER PUBLICATIONS

International Search Report issued Jun. 16, 2009 in PCT/JP09/01382 filed Mar. 27, 2009.

* cited by examiner

BURNER

TECHNICAL FIELD

The present invention relates to a burner on a wall surface of a boiler furnace to burn fuel such as pulverized coal or petroleum.

BACKGROUND ART

A wall surface of a boiler furnace is constituted by heat transfer pipes and is provided with a number of burners which burn pulverized coal, petroleum or other fuel in the furnace.

FIG. 1 shows a schematic diagram of a boiler which uses pulverized coal as fuel.

In FIG. 1, reference numeral 1 denotes a coal burning boiler furnace. In a lower portion of the furnace 1, pulverized coal burner groups 2 are arranged on plural stages (three stages are shown in FIG. 1). Each of the groups 2 includes a required number of pulverized coal burners 3 arranged horizontally along the wall surface.

Arranged above (downstream of) the pulverized coal burner groups 2 are over air port groups 4 on required stages (shown as one stage in the figure). Each of the groups 4 is constituted by a required number of over air ports 5 arranged horizontally. The over air ports 5 are arranged vertically above the corresponding pulverized coal burners 3.

The pulverized coal burner groups 2 are supplied with combustion air through combustion air supply passages 6 and 7. Supplied to the over air port groups 4 is two-step-combustion air through an over-air-port air combustion passage 8 branched from the supply passage 6. The pulverized coal burners 3 are supplied with pulverized coal from a coal pulverizer (not shown) along with combustion air.

In the furnace 1, pulverized coal is injected and burned along with one-step-combustion air from the pulverized coal burner groups 2. Further, the two-step-combustion air is injected from the over air port groups 4 and is mixed with a combustion gas to reduce $NO_x$ and facilitate combustion of a solid unburned portion (char) in the combustion gas; and further CO gas is burned.

Dampers 9 and 10 for airflow rate adjustment are incorporated in the combustion air supply passage 7 connected to the pulverized coal burners 3 and in the over-air-port air combustion passage 8 connected to the over air ports 5, respectively.

An example of a conventional burner will be described in terms of the pulverized coal burner 3 with reference to FIG. 2.

In FIG. 2, reference numeral 1 denotes a furnace; and 12, a wall of the furnace 1.

The furnace wall 12 has a throat 13. Attached to the furnace wall 12 on a side away from the furnace 1 is a wind box 14 which houses the pulverized coal burner 3 concentrically of the throat 13. The wind box 14 is connected with the combustion air supply passage 7.

The pulverized coal burner 3 comprises a nozzle body 16 and a secondary air adjuster 17 surrounding a leading end (an end near the furnace) of the nozzle body 16.

The nozzle body 16 comprises concentric outer and inner cylinder nozzles 18 and 19 and an oil burner 20 arranged axially of the nozzle 19. The outer and inner cylinder nozzles 18 and 19 have circular cross-sections to define together a fuel conduction space 21 as a hollow cylindrical space with an open end near the furnace 1.

Tangentially communicated with a base (an end away from the furnace 1) of the outer cylinder nozzle 18 is a primary air induction pipe 22 connected to a coal pulverizer (not shown). Through the induction pipe 22, primary air 24 and pulverized coal entrained thereon flow tangentially into and swirl in the fuel conduction space 21 and are injected through a leading end of the space 21.

Opened to a base of the inner cylinder nozzle 19 is an end of a tertiary air induction pipe 23 the other end of which is opened to the wind box 14 so as to take in and guide combustion air delivered to the wind box 14 to the inner cylinder nozzle 19 as combustion auxiliary air, i.e., tertiary combustion air.

The secondary air adjuster 17 comprises an auxiliary air adjustment mechanism 25 which houses a leading end of the nozzle body 16, and a main air adjustment mechanism 26 arranged concentrically outside of the adjustment mechanism 25 in an overlapping manner.

The auxiliary air adjustment mechanism 25 comprises a first air guide duct 28 reduced in diameter toward the leading end and a number of inner air vanes 29 arranged pivotally. The inner air vanes 29 are synchronously pivotable through a link mechanism (not shown) to change their tilt angle to air flow. The main air adjustment mechanism 26 comprises a second air guide duct 32 reduced in diameter toward the leading end and a number of outer air vanes 33 arranged pivotally and circumferentially equidistantly. The outer air vanes 33 are synchronously pivotable through a link mechanism (not shown) to change their tilt angle to the air flow as is the case with the inner air vanes 29.

The leading end of the second air guide duct 32 is contiguous with the throat 13. The leading end of the first air guide duct 28 is set back from an inner wall surface of the furnace wall 12. The leading ends of the cylinder nozzles 18 and 19 are further set back from the leading end of the first air guide duct 28.

Combustion in the above-mentioned pulverized coal burner 3 will be briefly described. Pulverized coal is supplied along with the primary air 24 from the primary air induction pipe 22 to the base of the fuel conduction space 21. The primary air 24 flows toward the furnace 1 while swirling in the space 21, is contracted during its passage through the space 21 and is injected through the leading end of the outer cylinder nozzle 18. Secondary air 34, which is auxiliary combustion air raised to a required temperature, is supplied to the wind box 14. The secondary air 34 is swirled by the outer air vanes 33 and injected through the second air guide duct 32 to the furnace 1 along with the primary air 24 and the pulverized coal.

In the course of injection to the furnace 1, the pulverized coal is uniformized by swirling in the space 21, raised in temperature by the secondary air 34 and further heated by receiving radiation heat from the furnace 1. Such heating causes the pulverized coal to release a volatile content which is ignited to continuously maintain flames.

A portion of the secondary air 34 taken into the second air guide duct 32 is taken into the first air guide duct 28 through the inner air vanes 29 and is injected as secondary auxiliary air. The inner air vanes 29 are tilted to the air flow to swirl the taken portion of the secondary air 34.

A state of a supply flow rate of the secondary air 34 is changed by airflow rate adjustment by the outer air vanes 33 and swirling strength and airflow rate adjustments by the inner air vanes 29 to thereby adjust a combustion state of the pulverized coal.

Moreover, a portion of the secondary air 34 is guided as tertiary air 35 through the tertiary air induction pipe 23 to the inner cylinder nozzle 19 and is injected through the inner cylinder nozzle 19. The combustion state of the pulverized coal is adjusted by injecting the tertiary air 35. Thus, the combustion state of the pulverized coal is optimized by the adjustments of the secondary and tertiary airs 34 and 35, etc.

In the above-mentioned conventional pulverized coal burner 3, the outer and inner air vanes 33 and 29 are coupled by their respective link mechanisms so that higher processing accuracy of parts and delicate assembly adjustment by a skilled mechanic are required for accurate assembling without backlash, which increase manufacturing cost and make cost reduction difficult.

Backlash, which inevitably increases over time in the link mechanisms, brings about variation of the tilt angles of the inner and outer air vanes 29 and 33 from the initial setting, leading to significant variation in swirling strength. Change of the angles of the inner and outer air vanes 29 and 33 for compensation of the airflow rate and the swirling strength is problematic in that an input angle does not correspond to an actual change amount and that a time-lag occurs upon change of an angle of the vanes. Thus, it is considered that highly accurate combustion control may become difficult.

A general technical level of burners is disclosed, for example, in JP 58-127005A.

SUMMARY OF INVENTION

Technical Problems

The invention was made in view of the above and has its object to simplify a configuration to achieve reduction in manufacturing cost as well as prevention of change in air vane angle with time and to acquire a stable swirling flow to realize stable combustion and achieve reduction in maintenance cost.

Solution To Problems

The invention is directed to a burner arranged axially of a burner throat on a furnace wall and comprising a nozzle body housed in a wind box and with a secondary air adjuster on a leading end of said nozzle body, said secondary air adjuster comprising an end plate for defining together with a near-furnace side surface of said wind box a cylindrical space opened in an outer circumference thereof, a slide damper axially slidable for surrounding said cylindrical space, air vanes arranged at predetermined intervals and circumferentially of said cylindrical space for swirling a secondary air and drive means for slide movement of said slide damper.

The invention is also directed to the burner having a partition plate for axially partitioning said cylindrical space, said air vanes being arranged circumferentially at predetermined intervals in at least one of partitioned small cylindrical spaces to swirl the secondary air.

The invention is also directed to the burner wherein pressure loss adjusting means is arranged in a small cylindrical space with no air vanes among said small cylindrical spaces.

The invention is also directed to the burner wherein said slide damper has an axial length at least blocking the small cylindrical space with no air vanes.

The invention is also directed to the burner wherein said slide damper comprises a plurality of concentrically overlapping cylindrical bodies slidable independently one another.

The invention is also directed to the burner wherein said slide damper is such that said plural cylindrical bodies are capable of blocking the cylindrical space.

The invention is also directed to the burner wherein said slide damper comprises at least three cylindrical bodies independently slidable one another, whereby the cylindrical space may be opened at any position with any width.

The invention is also directed to the burner wherein said cylindrical space is divided into three or more small cylindrical spaces by a plurality of partition plates, said air vanes being arranged in said small cylindrical spaces except one space, said air vanes having a different tilt angle for each of said small cylindrical spaces.

The invention is also directed to the burner wherein said air vanes are arranged end-to-end between said end plate and the near-furnace side surface of said wind box, said air vanes having tilt angles varying along an axial direction.

The invention is also directed to the burner wherein an auxiliary air induction passage is formed around said nozzle body centrally of the cylindrical space, an auxiliary cylindrical space being formed adjacent to the cylindrical space, said auxiliary cylindrical space being in communication with said auxiliary air induction passage and open at an outer circumference thereof to the wind box, auxiliary air vanes being arranged in said auxiliary cylindrical space at predetermined intervals along a circumference thereof.

The invention is also directed to the burner wherein a slidable auxiliary slide damper is arranged to surround said auxiliary cylindrical space, opening of said auxiliary cylindrical space being adjustable by said auxiliary slide damper.

Advantageous Effects of Invention

Various excellent advantageous effects will be acquired. According to the invention, the burner is arranged axially of the burner throat on the furnace wall and comprises the nozzle body housed in the wind box and with the secondary air adjuster on the leading end of the nozzle body, the secondary air adjuster comprising the end plate for defining together with the near-furnace side surface of the wind box the cylindrical space opened in the outer circumference thereof, the slide damper axially slidable for surrounding the cylindrical space, the air vanes arranged at the predetermined intervals and circumferentially of the cylindrical space for swirling the secondary air and the drive means for slide movement of the slide damper. As a result, the air vanes are fixedly arranged; the configuration is simple; no backlash is generated over time; reduction in manufacturing cost is achieved and a stable swirling flow is acquired; and a stable combustion can be realized.

According to the invention, which provides a partition plate for axially partitioning said cylindrical space and said air vanes arranged circumferentially at predetermined intervals in at least one of partitioned small cylindrical spaces to swirl the secondary air, a swirling flow strength is adjustable with a simple configuration and a simple operation by adjusting and mixing airflows of the secondary air swirled and the secondary air not swirled.

According to the invention, in which the pressure loss adjusting means is arranged in a small cylindrical space with no air vanes among said small cylindrical spaces, a difference in pressure loss can be eliminated between the secondary air swirled and the secondary air not swirled to simplify the airflow rate adjustment.

According to the invention, in which said slide damper has an axial length at least blocking the small cylindrical space with no air vanes, the swirling strength of the supplied secondary air is adjustable.

According to the invention, in which said slide damper comprises a plurality of concentrically overlapping cylindrical bodies slidable independently on another, the opening state of the cylindrical space is diversified to enable a wide range of air adjustment.

According to the invention, in which said slide damper is capable of blocking the cylindrical space with the plurality of the cylindrical bodies, the secondary air is stoppable and a damper for a secondary air system can be eliminated.

According to the invention, in which said slide damper comprises at least three cylindrical bodies independently slidable one another to enable opening of the cylindrical space at any position with any width, a wide variety of air adjustment is enabled.

According to the invention, in which said cylindrical space is divided into three or more small cylindrical spaces by a plurality of partition plates, said air vanes being arranged in the small cylindrical spaces except one space, the air vanes have a different tilt angle for each of the small cylindrical spaces, the airflow rate and swirling strength of the secondary air can be adjusted by opening the cylindrical space at any position with any width.

According to the invention, in which the air vanes are arranged end-to-end between said end plate and the near-furnace side surface of said wind box and the air vanes have tilt angles varying along an axial direction, the airflow rate and swirling strength of the secondary air can be adjusted by opening the cylindrical space at any position with any width.

According to the invention, the auxiliary air induction passage is formed around the nozzle body centrally of the cylindrical space, the auxiliary cylindrical space being formed adjacent to the cylindrical space, said auxiliary cylindrical space being in communication with said auxiliary air induction passage and open at an outer circumference thereof to the wind box, the auxiliary air vanes being arranged in said auxiliary cylindrical space at predetermined intervals along a circumference thereof. As a result, auxiliary air can be supplied centrally to the secondary air to enable highly accurate combustion control.

According to the invention, in which the slidable auxiliary slide damper is arranged to surround the auxiliary cylindrical space, the opening of said auxiliary cylindrical space being adjustable by said auxiliary slide damper, an amount of the auxiliary air can be adjusted to enable more highly accurate combustion control.

REFERENCE SIGNS LIST

Figure 1:
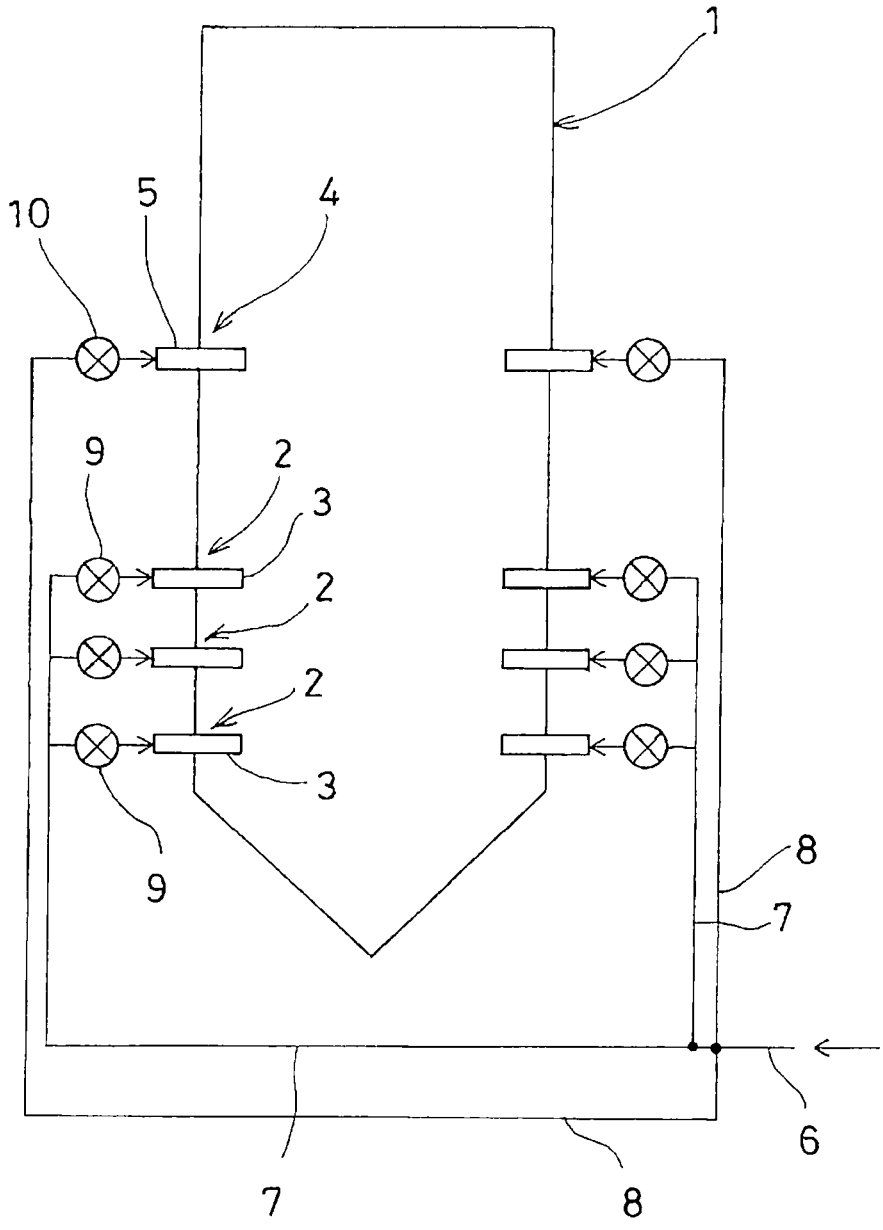
FIG. 1 is a schematic diagram of a coal burning boiler.

1 furnace
12 furnace wall
14 wind box
15 pulverized coal burner
16 nozzle body
18 outer cylinder nozzle
34 secondary air
36 air adjuster
37 end plate
38 partition plate
39 furnace wall outer surface
41 air vane
42 cylindrical space
43 slide damper
44 actuator
46 near-furnace air induction chamber
47 away-furnace air induction chamber
48 porous member
51 auxiliary air adjuster
53 auxiliary air adjusting end plate
54 auxiliary cylindrical space
55 auxiliary slide damper
56 auxiliary air induction passage

DESCRIPTION OF EMBODIMENTS

Embodiments of the invention will be described with reference to the drawings.

Figure 3:
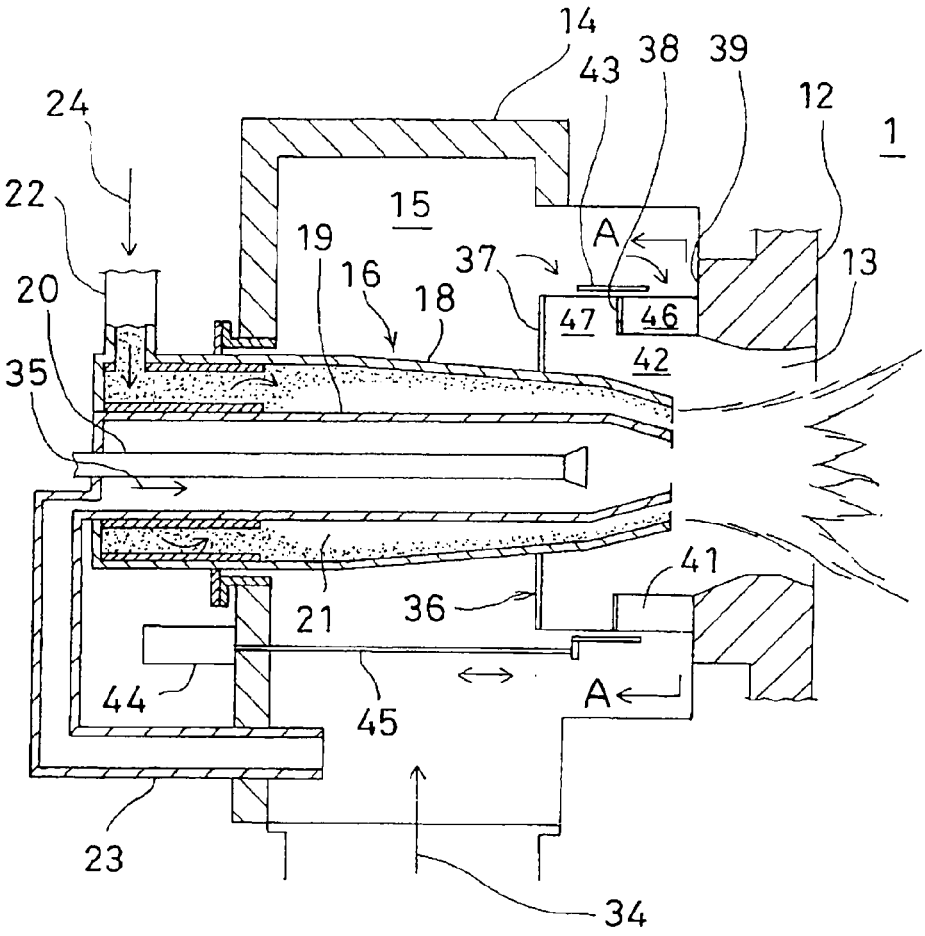
FIG. 3 is a schematic cross section of a pulverized coal burner according to a first embodiment of the invention.

FIG. 3 shows a first embodiment of the invention applied to a pulverized coal burner.

Figure 2:
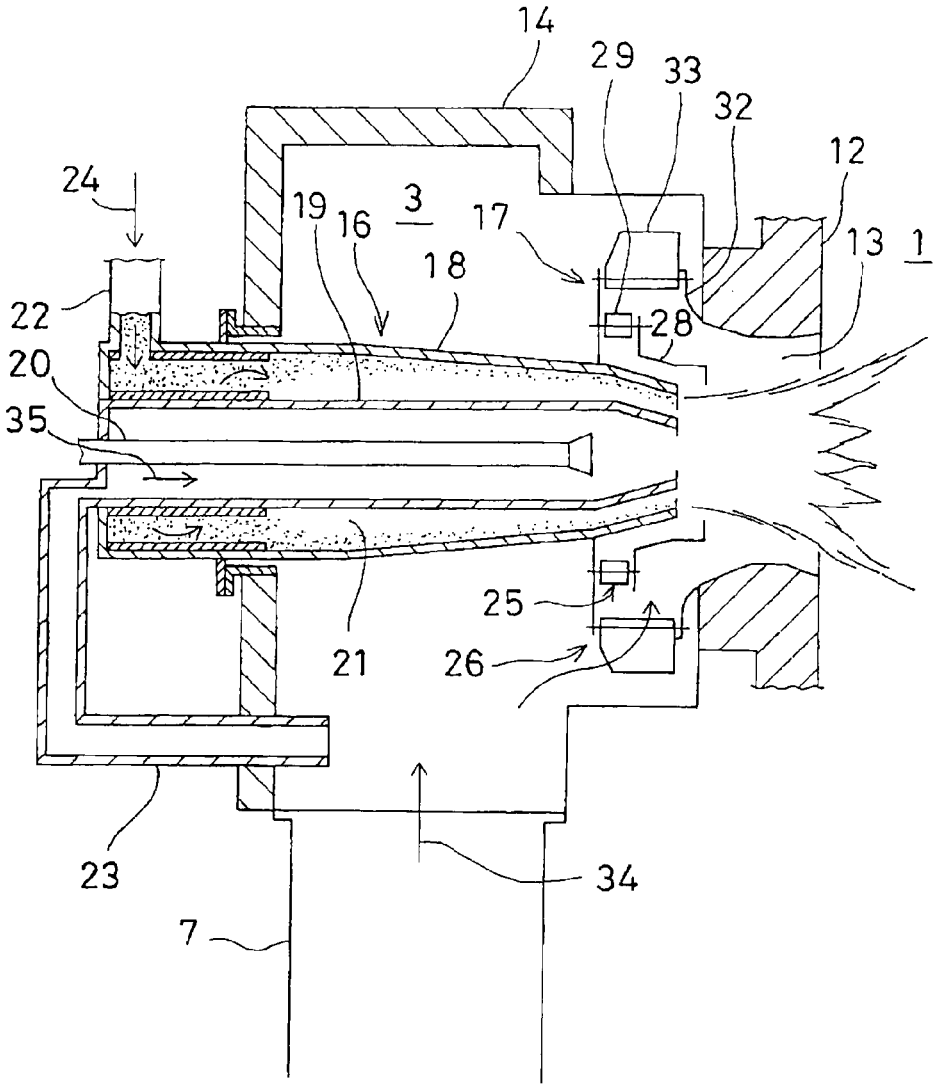
FIG. 2 is a schematic cross section of a conventional pulverized coal burner.

In the figure, parts equivalent to those shown in FIG. 2 are denoted by same reference numerals and will not be detailed.

A pulverized coal burner 15 is housed in a wind box 14 and an air adjuster 36 is arranged to house a leading end of a nozzle body 16. Through the wind box 14, secondary air 34 is taken in from surroundings of and swirled by the air adjuster 36 and flows out toward a throat 13.

Figure 4:
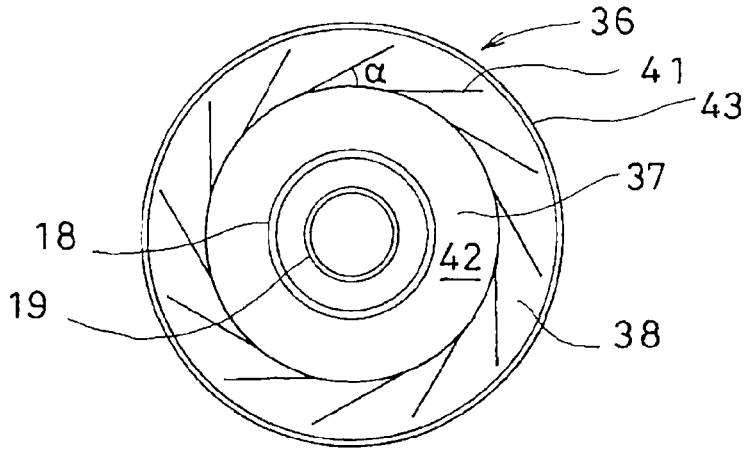
FIG. 4 is an arrow view taken along A-A of FIG. 3.

Next, the air adjuster 36 will be described with reference to FIG. 4.

An end plate 37 is attached to an outer cylinder nozzle 18 at a position away from an furnace wall outer surface 39 (or a surface of the wind box 14 adjacent to the furnace) by a required distance. The end plate 37 is perpendicular to an axis of the nozzle body 16 and is disk-shaped concentrically of the nozzle body 16.

Arranged between the furnace wall outer surface 39 and the end plate 37 is a ring-shaped partition plate 38 with an outer diameter equal to that of the end plate 37. Arranged at predetermined circumferential intervals between the partition plate 38 and the furnace wall outer surface 39 are air vanes 41 which have inner ends aligned with an inner circumferential of the partition plate 38 or set back from the same by a distance toward the outer circumference thereof.

The air vanes 41 are circumferentially equidistantly arranged within a range of about 10 to 40 vanes depending on a size of the pulverized coal burner 15 and are tilted by a tilt angle $\alpha$ relative to respective tangent lines of a circle passing through the inner ends of the air vanes 41, the tilt angle $\alpha$ being set within a range of 25 degrees±10 degrees.

Alternatively, the air vanes 41 may be arranged between the end and partition plates 37 and 38.

The end plate 37 and the furnace wall outer surface 39 define together a cylindrical space 42 concentrically of the outer cylinder nozzle 18. The cylindrical space 42 is opened at an outer circumference thereof to communicate with the inside of the wind box 14. The outer circumference of the cylindrical space 42 is partitioned by the partition plate 38 into near- and away-furnace air induction chambers 46 and 47 in communication with each other in their inner circumferential portions.

Arranged concentrically of and to surround the cylindrical space 42 is a short cylindrical slide damper 43 with a width (an axial length) at least greater than a distance between the end and partition plates 37 and 38 and slidably fitted with the end and partition plates 37 and 38.

Attached to an outer side surface of the wind box 14 is a hydraulic cylinder or other actuator 44 connected through a rod 45 to the slide damper 43 such that the slide damper 43 is driven by the actuator 44 to slide. The actuator 44 and the rod 45 constitute a drive means for slide movement of the slide damper 43.

An operation of the first embodiment will be described.

When the secondary air 34 is to be swirled for combustion, the slide damper 43 is retracted (moved away from the furnace) by the actuator 44 to block between the end and partition plates 37 and 38. The secondary air 34 passes through the air vanes 41 to be swirled during its passage through the air vanes 41 and flows out as a swirling flow to the throat 13. The swirling strength is maximal in this state.

When the secondary air 34 is not to be swirled, the slide damper 43 is advanced by the actuator 44 to block between the partition plate 38 and the furnace wall outer surface 39. Thus, the secondary air 34 is prevented from flowing into the air vanes 41 and flows out to the throat 13 through the away-furnace air induction chamber 47 and the cylindrical space 42 without swirling.

When the swirling strength of the secondary air 34 is to be adjusted, the slide damper 43 is located at an intermediate position as shown in FIG. 3 to partially open each of the near- and away-furnace air induction chambers 46 and 47.

A portion of the secondary air 34 flows into the near-furnace air induction chamber 46 and a remainder flows into the away-furnace air induction chamber 47. The secondary air 34 flowing into the near-furnace air induction chamber 46 is swirled by the air vanes 41. The secondary air 34 flowing into the away-furnace air induction chamber 47 is not swirled and merges with the secondary air 34 flowing out through the near-furnace air induction chamber 46.

The strength of the swirling flow of the secondary air 34 from the near-furnace air induction chamber 46 is canceled out by merging with the secondary air 34 having no swirling flow, and a swirling flow with the swirling strength reduced is supplied to the throat 13.

Thus, the position of the slide damper 43 may be adjusted to supply the secondary air 34 ranging from maximum swirling flow to no swirling flow to thereby adjust the combustion state of the pulverized coal burner 15.

In the pulverized coal burner 15 described above, the air vanes 41 are fixedly arranged and the tilt angle of the air vanes 41 does not change over time. Moreover, no movable portion exists between the connected slide damper 43 and rod 45, so that no backlash increases over time and a displacement given by the actuator 44 is accurately transferred to the slide damper 43, resulting in no reduction in accuracy of the positional adjustment of the slide damper 43 over time.

In the first embodiment, the away-furnace air induction chamber 47 may be eliminated. That is, the air vanes 41 may be arranged between the end plate 37 and the furnace wall outer surface 39 with the axial length of the slide damper 43 being set equivalent to the axial length of the near-furnace air induction chamber 46; in this case, an opening degree may be adjusted by moving the slide damper 43 to adjust a supplied airflow rate of the secondary air 34.

Figure 5:
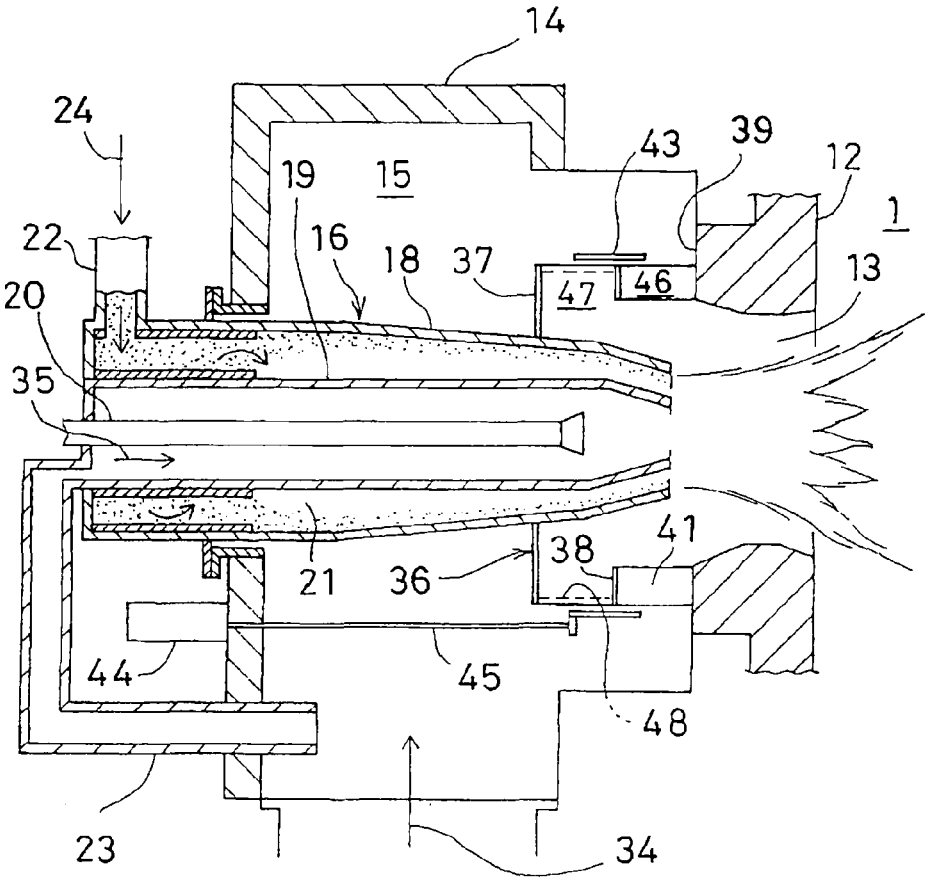
FIG. 5 is a schematic cross section of a pulverized coal burner according to a second embodiment of the invention.

FIG. 5 shows a second embodiment. In FIG. 5, parts equivalent to those shown in FIG. 3 are denoted by same reference numerals and will not be described.

In the second embodiment, a porous member 48 such as a punching metal or mesh is arranged on a circumference at which the away-furnace air induction chamber 47 is opened.

With a state where no porous member 48 is arranged, the secondary air 34 flowing into the near-furnace air induction chamber 46 has a pressure loss due to its passing through the air vanes 41 whereas the secondary air 34 flowing into the away-furnace air induction chamber 47 has no pressure loss since no resistance exists. Therefore, a supplied airflow rate varies between the blocking of the near-furnace air induction chamber 46 and the blocking of the away-furnace air induction chamber 47. Thus, the flow rate of blown air must be adjusted on the supplying side of the primary air 24 in accordance with the air adjustment by the slide damper 43; alternatively, airflow rate or pressure must be adjusted by an adjustment damper not shown (corresponding to the damper 9 shown in FIG. 1) arranged on the supplying side of the secondary air 34.

By arranging the porous member 48 which is pressure loss adjusting means and which has a pressure loss equivalent to that by the air vanes 41, an air flow rate delivered through the air adjuster 36 can be maintained at a predetermined value regardless of a position of the slide damper 43.

Figure 6:
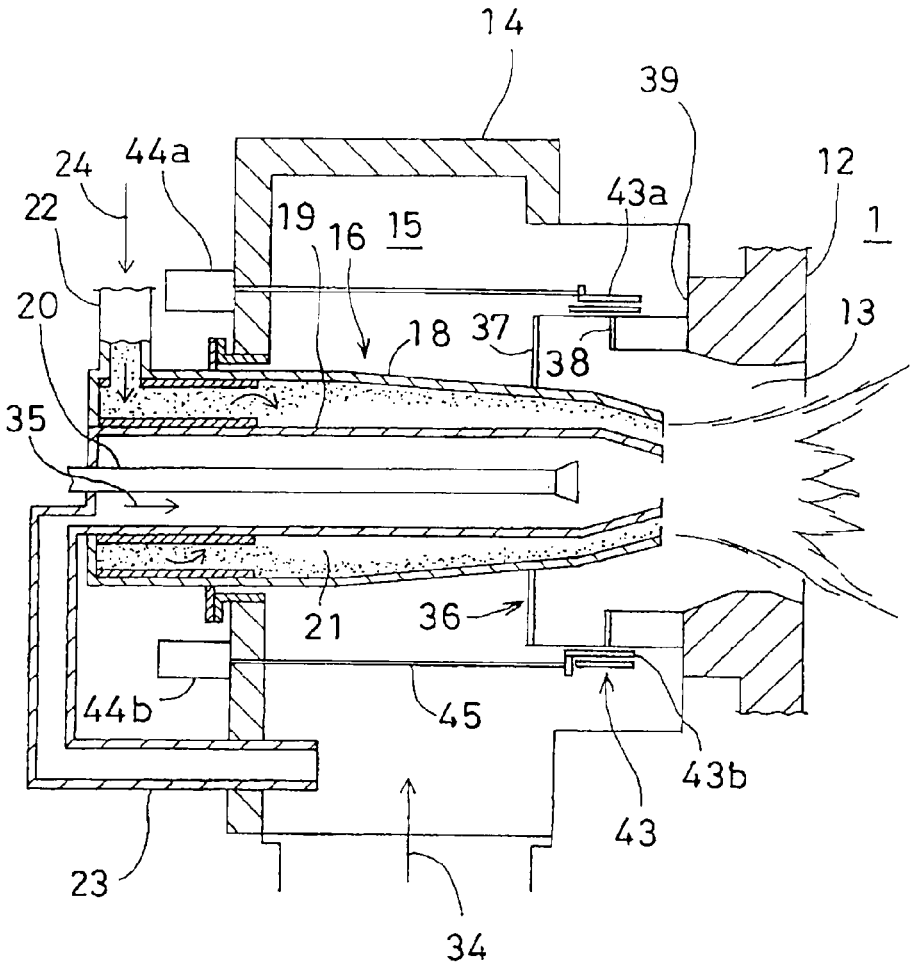
FIG. 6 is a schematic cross section of a pulverized coal burner according to a third embodiment of the invention.

FIG. 6 shows a third embodiment. In FIG. 6, parts equivalent to those shown in FIG. 3 are denoted by same reference numerals and will not be described.

In the third embodiment, the slide damper 43 has a divided configuration constituted by a plurality of cylindrical bodies to achieve diversification of the air adjustment by the air adjuster 36. Shown is a case of two-part configuration.

The slide damper 43 comprises first and second slide dampers 43*a* and 43*b* which are arranged like concentric circles and freely slidable without interfering with each other. The first and second slide dampers 43*a* and 43*b* are connected to and independently drivable by first and second actuators 44*a* and 44*b*, respectively.

An operation of the third embodiment will be described with reference to FIGS. 7 to 9.

Figure 8:
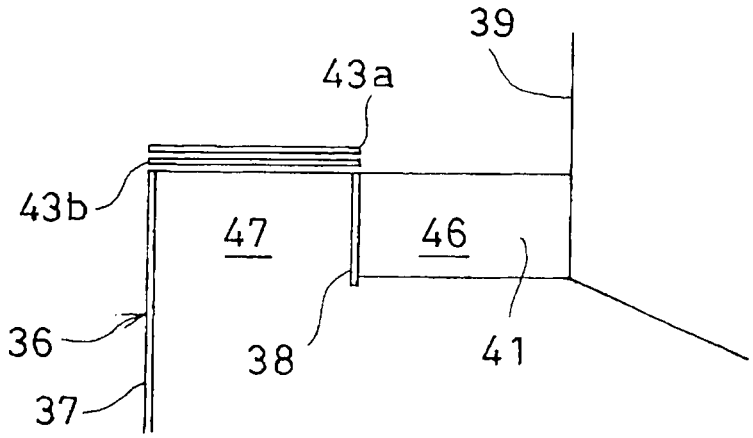
FIG. 8 is an explanatory diagram of an operation in the third embodiment indicative of the same operation as the first embodiment.
Figure 9:
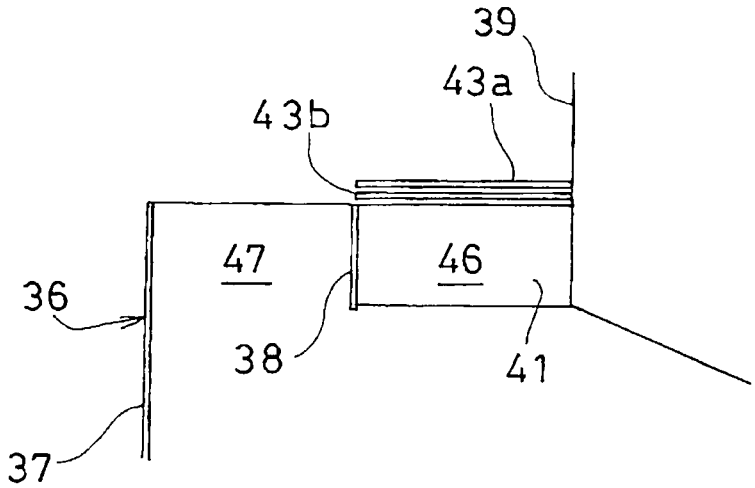
FIG. 9 is an explanatory diagram of an operation in the third embodiment indicative of the same operation as the first embodiment.

When the first and second slide dampers 43*a* and 43*b* are overlapped with each other and the first and second slide dampers 43*a* and 43*b* are synchronizingly and integrally moved, the operation equivalent to the first embodiment may be achieved (see FIGS. 8 and 9)

Figure 7:
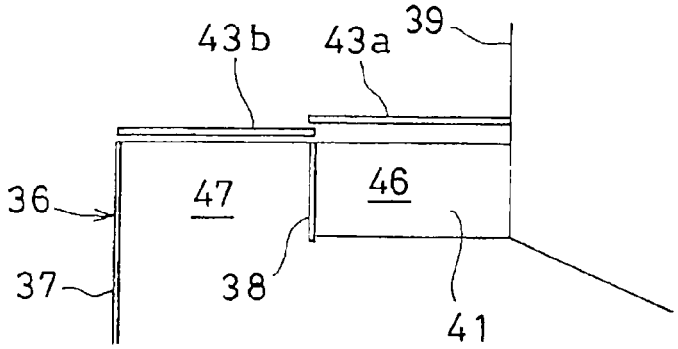
FIG. 7 is an explanatory diagram of an operation in the third embodiment indicative of a fully closed state of an air adjuster.

When the first and second slide dampers 43*a* and 43*b* block the near- and away-furnace air induction chambers 46 and 47, the air adjuster 36 can be put into a fully closed state (see FIG. 7).

This, which can stop the supply of the secondary air 34 by the air adjuster 36, leads to stoppage of the combustion by the relevant pulverized coal burner 15.

Since the air adjuster 36 has a function of stopping the supply of the secondary air, the damper 9 shown in FIG. 1 can be eliminated to achieve simplification in installation and in control system.

By partially overlapping the first and second slide dampers 43*a* and 43*b* and adjusting the overlapped width, an opening area is adjustable in each of the near- and away-furnace air induction chambers 46 and 47, so that the adjustment of the swirling strength and the adjustment of the supply airflow rate can be performed at the same time.

Figure 10:
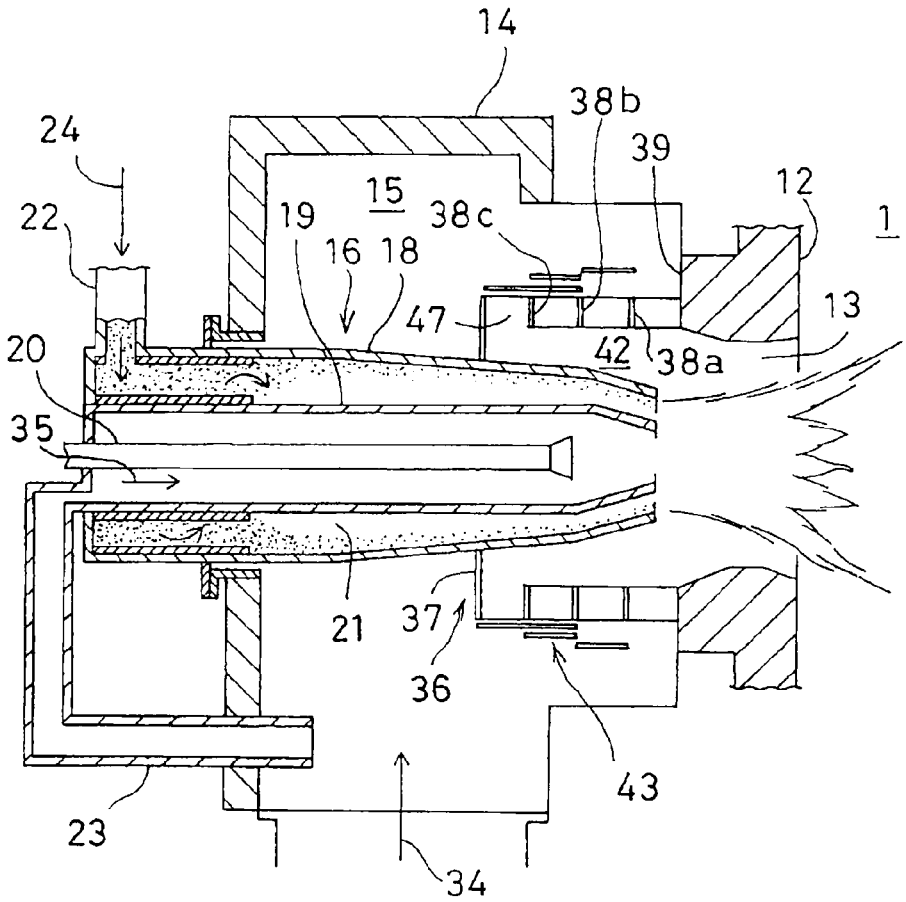
FIG. 10 is a schematic cross section of a pulverized coal burner according to a fourth embodiment of the invention.

FIG. 10 shows a fourth embodiment. In FIG. 10, parts equivalent to those shown in FIG. 3 are denoted by same reference numerals and will not be described. Actuators 44 driving the slide damper 43 are not shown.

In the fourth embodiment, the function of air adjustment by the air adjuster 36 is further diversified.

In the air adjuster 36 according to the fourth embodiment, partitions 38*a*, 38*b* and 38*c* are arranged in the cylindrical space 42 to axially and equally divide the same into four to form near-furnace air induction chambers 46*a*, 46*b* and 46*c* and an away-furnace air induction chamber 47 (see FIGS. 11 to 17).

The near-furnace air induction chambers 46*a*, 46*b* and 46*c* are provided with air vanes 41*a*, 41*b* and 41*c*, respectively, and tilt angles $\alpha a$, $\alpha b$ and $\alpha c$ of the air vanes 41*a*, 41*b* and 41*c* are set to $\alpha a<\alpha b<\alpha c$ such that the tilt angles progressively increase (the swirling strength is progressively reduced) toward the outside of the furnace.

The slide damper 43 has a three-part configuration and comprises slide dampers 43*a* and 43*b* having an axial length of ¼ of the cylindrical space 42 and a slide damper 43*c* having an axial length of ½ of the cylindrical space 42.

The slide dampers 43*a*, 43*b* and 43*c* have a circumferentially concentric circular configuration and are freely slidable without interfering with one another. The slide dampers 43*a*, 43*b* and 43*c* are individually connected to and slidable by actuators (not shown) independently one another.

Figure 11:
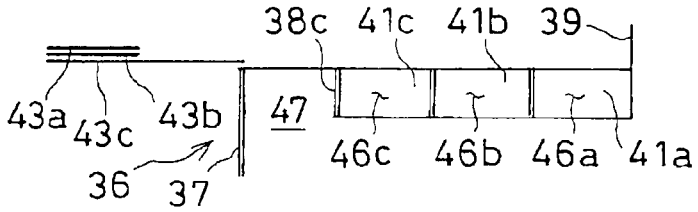
FIG. 11 is an explanatory diagram of an operation in the fourth embodiment indicative of a fully opened state of an air adjuster.

FIG. 11 shows a fully opened state of the air adjuster 36 with all the slide dampers 43*a*, 43*b* and 43*c* retracted from the opening of the air adjuster 36.

Figure 12:
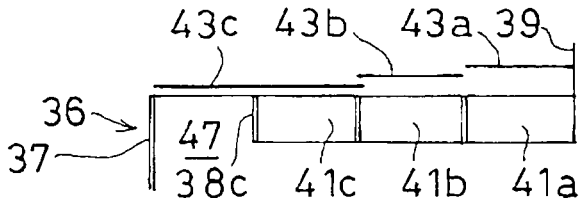
FIG. 12 is an explanatory diagram of an operation in the fourth embodiment indicative of a fully closed state of the air adjuster.

FIG. 12 shows a fully closed state of the air adjuster 36 with the slide dampers 43*a* and 43*b* blocking the near-furnace air induction chambers 46*a* and 46*b* and the slide damper 43*c* blocking the near- and away-furnace air induction chambers 46*c* and 47.

Figure 13:
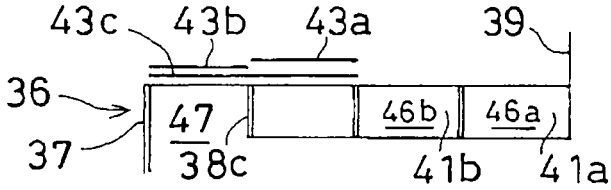
FIG. 13 is an explanatory diagram of an operation in the fourth embodiment indicative of a state of opening a portion of near-furnace air induction chambers.

As shown in FIG. 13, when the slide dampers 43*a* and 43*b* are overlapped with the slide damper 43*c*, the near-furnace air induction chambers 46*a* and 46*b* are opened and the secondary air 34 swirled by the air vanes 41*a* and 41*b* is introduced into the throat 13. Since the air vanes 41*a* and 41*b* have different tilt angles, the secondary air 34 having an intermediate swirling strength between two swirling strengths given by the air vanes 41*a* and 41*b* is introduced into the throat 13.

When, with the slide dampers 43*a* and 43*b* being overlapped with the slide damper 43*c*, these slide dampers are integrally moved toward the inside of the furnace to block the near-furnace air induction chambers 46*a* and 46*b* and open the away- and near-furnace air induction chambers 47 and 46*c*, the secondary air 34 not swirled through the away-furnace air induction chamber 47 and the secondary air 34 weakly swirled by the air vanes 41*c* are merged and introduced into the throat 13.

Figure 14:
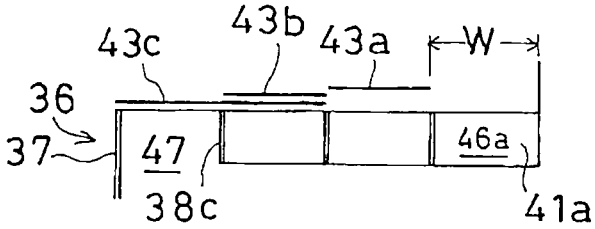
FIG. 14 is an explanatory diagram of an operation in the fourth embodiment indicative of a state of opening another portion of the near-furnace air induction chambers.

As shown in FIG. 14, if either the slide damper 43*a* or 43*b* (the slide damper 43*a* in FIG. 14) blocks the near-furnace air induction chamber 46*b* from the state of FIG. 13, only the near-furnace air induction chamber 46*a* is opened to supply the throat 13 with the secondary air 34 given a maximum swirling strength by the air vanes 41*a*.

If only the slide damper 43*a* is retracted in the state of FIG. 14, an opening width W is enlarged, increasing the supply airflow rate.

Figure 15:
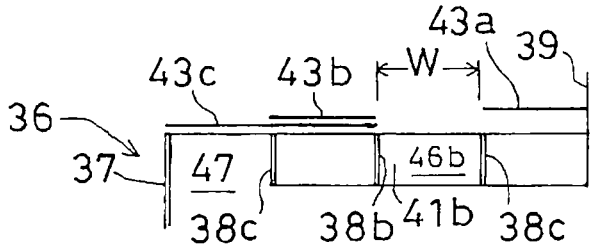
FIG. 15 is an explanatory diagram of an operation in the fourth embodiment indicative of a state of opening yet another portion of the near-furnace air induction chambers.

As shown in FIG. 15, if the slide damper 43*a* is advanced from the state of FIG. 14 to block the near-furnace air induction chamber 46*a*, only the near-furnace air induction chamber 46*b* is opened to supply the throat 13 with the secondary air 34 given a second swirling strength by the air vanes 41*b*.

If the slide dampers 43*b* and 43*c* are integrally retracted in the state of FIG. 15, the opening width W is enlarged to supply the secondary air 34 passing through the near-furnace air induction chamber 46*b* and a potion of the near-furnace air induction chamber 46*c*, increasing the supply airflow rate.

Figure 16:
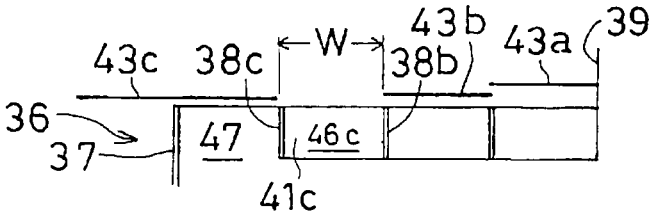
FIG. 16 is an explanatory diagram of an operation in the fourth embodiment indicative of a state of opening a further portion of the near-furnace air induction chambers.

As shown in FIG. 16, the slide damper 43*b* is advanced in the state of FIG. 15 to block the near-furnace air induction chamber 46*b* and the slide damper 43*c* is retracted to open the near-furnace air induction chamber 46*c*.

Then, the secondary air 34 flows into the near-furnace air induction chamber 46*c* and is given a swirling force by the air vanes 41*c* and supplied to the throat 13. In this case, since the tilt angle of the air vanes 41*c* is greater than the tilt angles of the air vanes 41*a* and 41*b*, the given swirling force is the smallest.

If the slide damper 43*c* is retracted and/or the slide damper 43*b* is advanced in the state of FIG. 16, the opening width W is enlarged to supply the secondary air 34 passing through the near-furnace air induction chamber 46*c* and the near-furnace air induction chamber 46*b* and/or a potion of the away-furnace air induction chamber 47, increasing the supply airflow rate.

Figure 17:
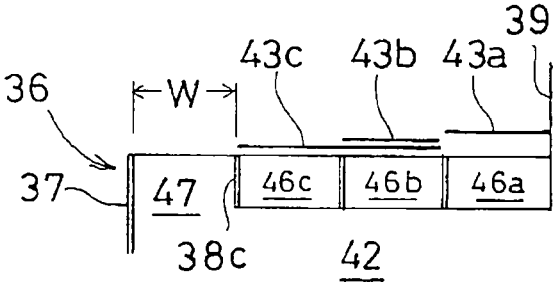
FIG. 17 is an explanatory diagram of an operation in the fourth embodiment indicative of a state of opening a away-furnace air induction chamber.

As shown in FIG. 17, if the slide damper 43*c* is advanced from the state of FIG. 16 to block the near-furnace air induction chambers 46*c* and 46*b* with the slide damper 43*c*, the away-furnace air induction chamber 47 is opened.

Then, the secondary air 34 flowing into the away-furnace air induction chamber 47 is supplied to the throat 13 without being swirled.

In this case, if it is desired to increase the supply airflow rate, the slide damper 43*c* is advanced to open a portion of the near-furnace air induction chamber 46*c*. A portion of the secondary air 34 passes through the near-furnace air induction chamber 46*c*, is swirled by the air vanes 41*c*, and merges with the secondary air 34 passing through the away-furnace air induction chamber 47.

In the fourth embodiment, the partitions 38*a*, 38*b* and 38*c* may be removed to arrange the continuous air vanes 41 end-to-end between the end plate 37 and the furnace wall outer surface 39 and the air vanes 41 may be formed with a small tilt angle on the near-furnace side such that the tilt angle progressively increases in a retracting direction and reaches 90 degrees on the away-furnace side. The configuration of the slide damper 43 is the same.

Since the secondary air 34 passes through a portion of each of the air vanes 41 having a different tilt angle when an opening position of the air adjuster 36 is different, the swirling strength of the secondary air 34 can be adjusted by changing an opening position of the air adjuster 36.

Although the slide damper 43 is equally divided into three parts in the fourth embodiment, the slide damper 43 may equally be divided into four or more parts.

Figure 18:
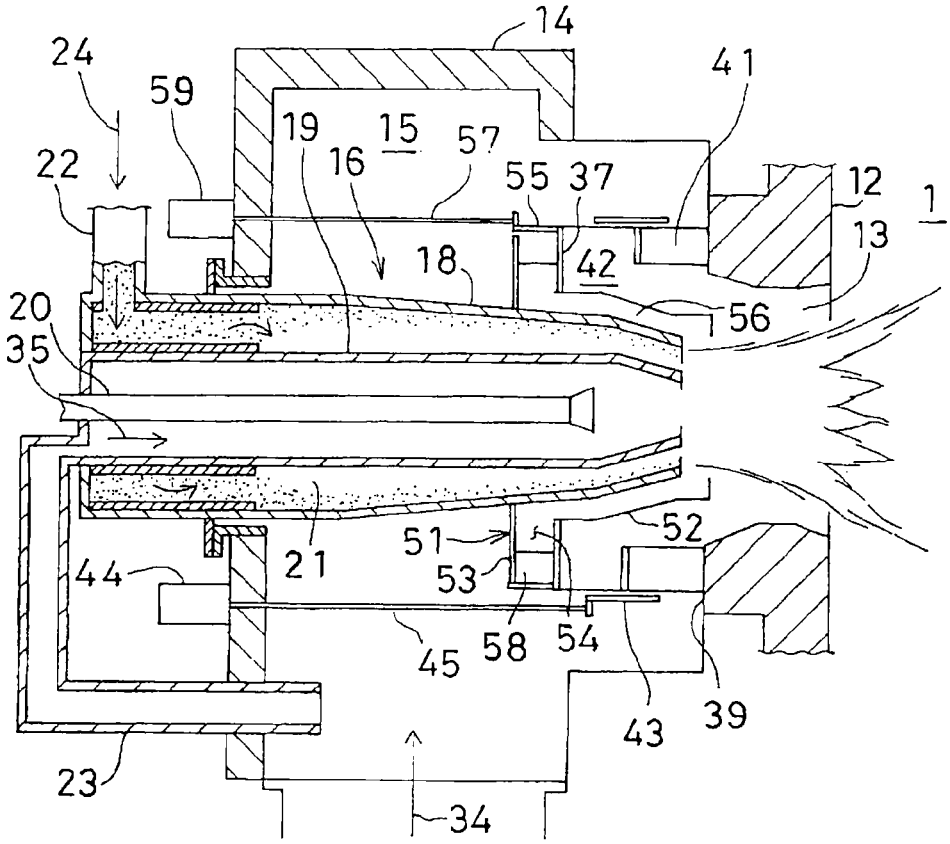
FIG. 18 is a schematic cross section of a pulverized coal burner according to a fifth embodiment of the invention.

FIG. 18 shows a fifth embodiment. In FIG. 18, parts equivalent to those shown in FIG. 3 are denoted by same reference numerals and will not be described.

In the fifth embodiment, an auxiliary air adjuster 51 is added to any of the embodiments described above. The auxiliary air adjuster 51 will be described.

At a leading end of the outer cylinder nozzle 18, an auxiliary air guide duct 52 is arranged concentrically of the outer cylinder nozzle 18 and the rear end of the auxiliary air guide duct 52 is attached to the end plate. The auxiliary air guide duct 52 is located centrally of the cylindrical space 42 to form a cylindrical auxiliary air induction passage 56 around the outer cylinder nozzle 18.

An auxiliary air adjusting end plate 53 is arranged to face the end plate 37 to define an auxiliary cylindrical space 54 adjacent to the cylindrical space 42 between the end plate 37 and the auxiliary air adjusting end plate 53 and the auxiliary cylindrical space 54 is opened in its outer circumference and in communication with the inside of the wind box 14.

An auxiliary slide damper 55 opening/closing the auxiliary cylindrical space 54 is slidably fitted to the auxiliary air adjusting end plate 53. A hydraulic cylinder or other actuator 59 is arranged on the outer side surface of the wind box 14 and is connected through a rod 57 to the auxiliary slide damper 55 such that the auxiliary slide damper 55 slides in accordance with driving of the actuator 44 to open/close the auxiliary cylindrical space 54.

Arranged at predetermined circumferential intervals end-to-end between the end plate 37 and the auxiliary air adjusting end plate 53 are auxiliary air vanes 58. As is the case with the air vanes 41, the auxiliary air vanes 58 are circumferentially equidistantly arranged within a range of about 10 to 40 vanes depending on a size of the pulverized coal burner 15 and are tilted by a tilt angle$\alpha$ relative to respective tangent lines of a circle passing through the inner ends of the auxiliary air vanes 58, the tilt angle $\alpha$ being set within a range of 25 degrees±10 degrees (see FIG. 4).

An operation of the fifth embodiment will be described with reference to FIG. 19.

Figure 19:
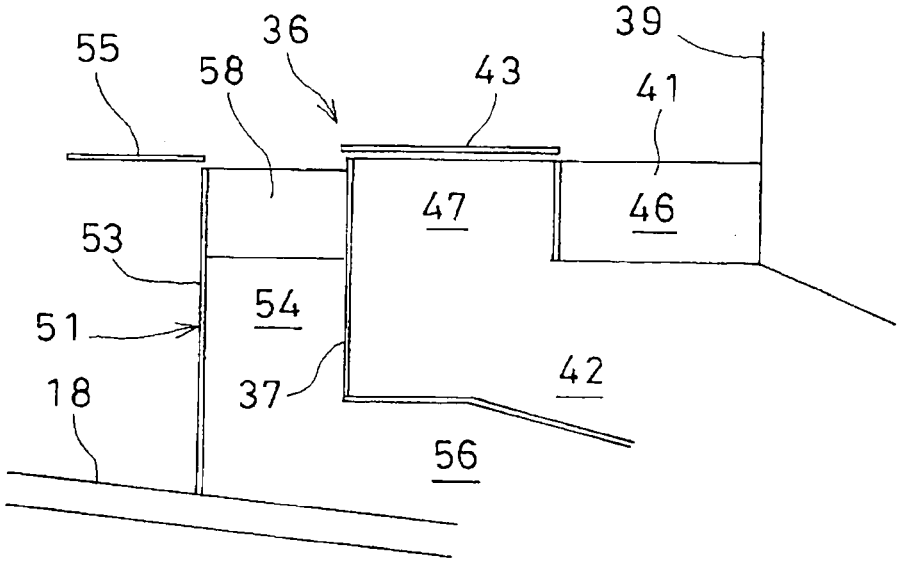
FIG. 19 is an explanatory diagram of an operation in the fifth embodiment.

In the state shown in FIG. 19, combustion air is swirled and supplied from both the air adjuster 36 and the auxiliary air adjuster 51 with the slide damper 43 being retracted to block the away-furnace air induction chamber 47 and the auxiliary slide damper 55 being retracted to open the auxiliary cylindrical space 54.

The secondary air 34 flowing into the near-furnace air induction chamber 46 is swirled by passing through the air vanes 41 and is supplied as a swirling flow to the throat 13.

Then, by advancing in position the slide damper 43, a portion of the near-furnace air induction chamber 46 is blocked and a portion of the away-furnace air induction chamber 47 is opened. In this state, since a non-swirling flow merges with the swirling flow from the near-furnace air induction chamber 46, the swirling flow is weakened.

The secondary air 34 flows into the auxiliary cylindrical space 54, is swirled by the auxiliary air vanes 58 and is injected as secondary auxiliary air via the auxiliary air induction passage 56 from within the secondary air 34 supplied by the air adjuster 36.

An opening width of the auxiliary cylindrical space 54 can be adjusted by a position of the auxiliary slide damper 55 to adjust the airflow rate of the secondary air 34 to be taken in, i.e., a supply amount of the secondary auxiliary air.

If adjustment of the supply amount of the secondary auxiliary air is not needed, the auxiliary slide damper 55 may be eliminated.

In the auxiliary air adjuster 51, the auxiliary slide damper 55 is fixedly arranged and no movable portion exists at connection between the rod 57 and the auxiliary slide damper 55, the backlash does not increase over time and a displacement given by the actuator 59 is accurately transferred to the auxiliary slide damper 55.

It is to be understood that the invention is not limited to a pulverized coal burner and may be implemented as a burner which burns petroleum or other fuel.

INDUSTRIAL APPLICABILITY

A burner of the invention is applicable to wall surfaces of various boiler furnaces.

The invention claimed is:

1. A burner arranged axially of a burner throat on a furnace wall and comprising:

a nozzle body housed in a wind box and with a secondary air adjuster on a leading end of said nozzle body, said secondary air adjuster including an end plate that defines together with a near-furnace side surface of said wind box a cylindrical space opened in an outer circumference thereof, a slide damper that is axially slidable and that surrounds said cylindrical space, a partition plate that axially partitions said cylindrical space, air vanes that are arranged circumferentially at predetermined intervals in at least one of partitioned small cylindrical spaces to swirl a secondary air, a pressure loss adjuster that includes a porous member arranged in a small cylindrical space with no air vanes among said small cylindrical spaces, the pressure loss adjuster produces a pressure loss equivalent to that by the air vanes, and a driver to slidably move said slide damper.

2. A burner as claimed in claim 1, wherein said slide damper has an axial length at least blocking the small cylindrical space with no air vanes.

3. A burner as claimed in claim 1, wherein said slide damper comprises a plurality of concentrically overlapping cylindrical bodies slidable independently one another.

4. A burner as claimed in claim 2, wherein said slide damper comprises a plurality of concentrically overlapping cylindrical bodies slidable independently one another.

5. A burner as claimed in claim 3, wherein said slide damper is such that said plural cylindrical bodies are capable of blocking the cylindrical space.

6. A burner as claimed in claim 4, wherein said slide damper is such that said plural cylindrical bodies are capable of blocking the cylindrical space.

7. A burner as claimed in claim 2, wherein said slide damper comprises at least three cylindrical bodies independently slidable one another, whereby the cylindrical space may be opened at any position with any width.

8. A burner as claimed in claim 1, wherein said cylindrical space is divided into three or more small cylindrical spaces by a plurality of partition plates, said air vanes being arranged in said small cylindrical spaces except one space, said air vanes having a different tilt angle for each of said small cylindrical spaces.

9. A burner as claimed in claim 1, wherein said air vanes are arranged end-to-end between said end plate and the near-furnace side surface of said wind box, said air vanes having tilt angles varying along an axial direction.

10. A burner as claimed in claim 8, wherein said air vanes are arranged between said end plate and the near-furnace side surface of said wind box, said air vanes having tilt angles varying along an axial direction.

11. A burner as claimed in claim 1, wherein an auxiliary air induction passage is formed around said nozzle body centrally of the cylindrical space, an auxiliary cylindrical space being formed adjacent to the cylindrical space, said auxiliary cylindrical space being in communication with said auxiliary air induction passage and open at an outer circumference thereof to the wind box, auxiliary air vanes being arranged in said auxiliary cylindrical space at predetermined intervals along a circumference thereof.

12. A burner as claimed in claim 11, wherein a slidable auxiliary slide damper is arranged to surround said auxiliary cylindrical space, opening of said auxiliary cylindrical space being adjustable by said auxiliary slide damper.

13. A burner as claimed in claim 3, wherein said slide damper comprises at least three cylindrical bodies independently slidable one another, whereby the cylindrical space may be opened at any position with any width.

14. A burner as claimed in claim 4, wherein said slide damper comprises at least three cylindrical bodies independently slidable one another, whereby the cylindrical space may be opened at any position with any width.

15. A burner as claimed in claim 5, wherein said slide damper comprises at least three cylindrical bodies independently slidable one another, whereby the cylindrical space may be opened at any position with any width.

16. A burner as claimed in claim 6, wherein said slide damper comprises at least three cylindrical bodies independently slidable one another, whereby the cylindrical space may be opened at any position with any width.

* * * * *

UNITED STATES PATENT AND TRADEMARK OFFICE

CERTIFICATE OF CORRECTION

PATENT NO. : 8,726,819 B2
APPLICATION NO. : 13/057762
DATED : May 20, 2014
INVENTOR(S) : Masato Tamura et al.

It is certified that error appears in the above-identified patent and that said Letters Patent is hereby corrected as shown below:

On the title page, Item (86), the PCT information is incorrect. Item (86) should read:

--(86) PCT No.: PCT/JP2009/001382

§ 371 (c)(1),
(2), (4) Date: Feb. 5, 2011--

Signed and Sealed this
Twelfth Day of August, 2014

Michelle K. Lee

Michelle K. Lee
*Deputy Director of the United States Patent and Trademark Office*